US007799980B1

(12) United States Patent
Register

(10) Patent No.: US 7,799,980 B1
(45) Date of Patent: Sep. 21, 2010

(54) OCARINA

(76) Inventor: Norman Spencer Register, 1028 Sevens Creeks Hwy., Whiteville, NC (US) 28472

( * ) Notice: Subject to any disclaimer, the term of this patent is extended or adjusted under 35 U.S.C. 154(b) by 0 days.

(21) Appl. No.: 12/387,165

(22) Filed: Apr. 29, 2009

(51) Int. Cl.
*G10D 7/02* (2006.01)

(52) U.S. Cl. ..... 84/384

(58) Field of Classification Search ..... 84/384, 84/380 C

See application file for complete search history.

(56) References Cited

U.S. PATENT DOCUMENTS

| | | | | |
|---|---|---|---|---|
| 1,788,613 | A | 1/1931 | Bernard | |
| 2,145,605 | A | 1/1939 | Mausolf | 84/380 |
| 2,194,332 | A | 3/1940 | Sumner | 84/380 |
| 2,195,992 | A | 4/1940 | Mausolf | 84/330 |
| 2,332,083 | A | 10/1943 | Jauch | 84/382 |
| 2,460,931 | A | 2/1949 | Gretsch | 84/380 |
| 2,485,749 | A | 10/1949 | Ladd | 84/384 |
| 2,513,600 | A | 7/1950 | Thompson | 46/182 |
| 2,610,538 | A | 9/1952 | Lederfine | 84/377 |
| 4,893,541 | A * | 1/1990 | Fowler et al. | 84/380 C |
| 6,914,179 | B2 * | 7/2005 | Ahrens | 84/384 |

FOREIGN PATENT DOCUMENTS

| | | | |
|---|---|---|---|
| JP | 410222157 | A | 8/1998 |
| JP | 02006284996 | A | 10/2006 |
| JP | 2006284996 | A * | 10/2006 |

* cited by examiner

*Primary Examiner*—Jianchun Qin
(74) *Attorney, Agent, or Firm*—Michael E. Mauney

(57) ABSTRACT

An improved ocarina for providing improved tonal quality with better maintenance of said tonal quality. Ocarinas are generally oval in shape with finger holes on one side and thumb holes on the other side of the ocarina, with a windway and a sound hole called a "voicing". A user blows into the voicing, creating a tone which varies depending on whether the fingers and thumbs are over the finger holes or thumb holes. Partitions are placed inside of said ocarina between said thumb hole and said sound hole which are customarily located on the same side of the ocarina. Partitions are located close to the thumb holes and distal from the sound hole. In the improved ocarina, a user may open the thumb hole without significant loss of tonal quality, unlike a standard ocarina where opening of the thumb holes ordinarily results in a decreased tonal quality.

11 Claims, 5 Drawing Sheets

Prior Art

FIG. 3A
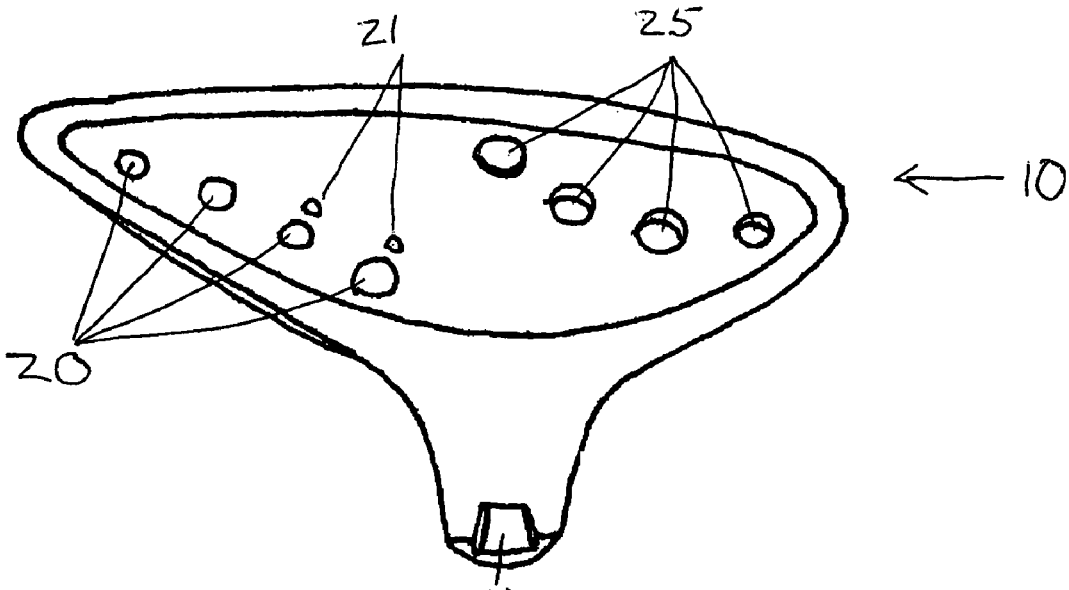
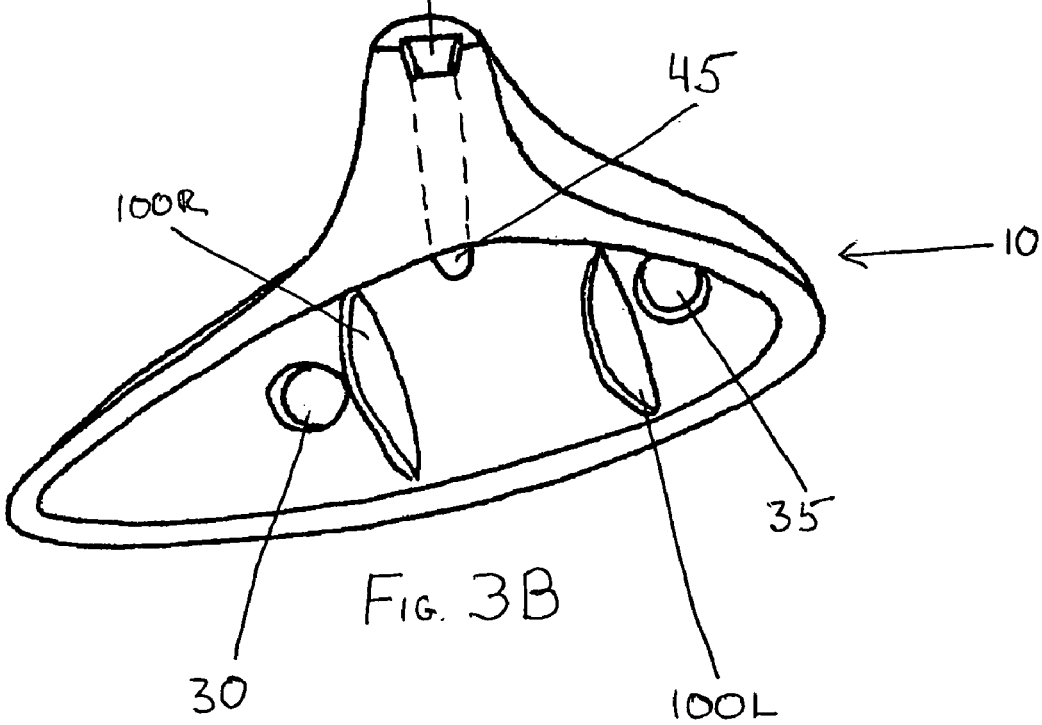
FIG. 3B

FIG. 4
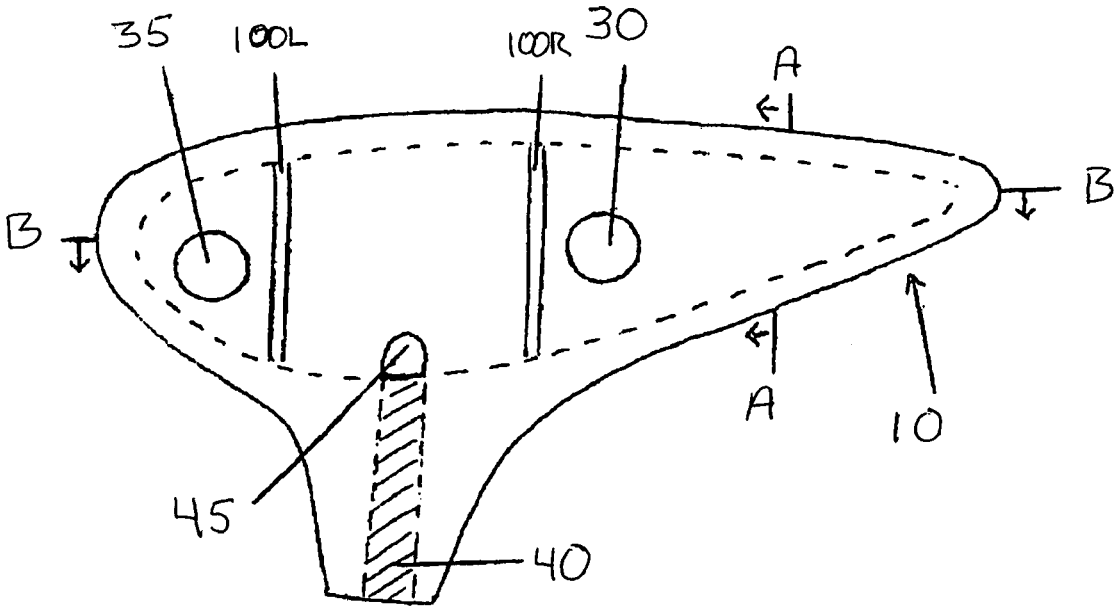
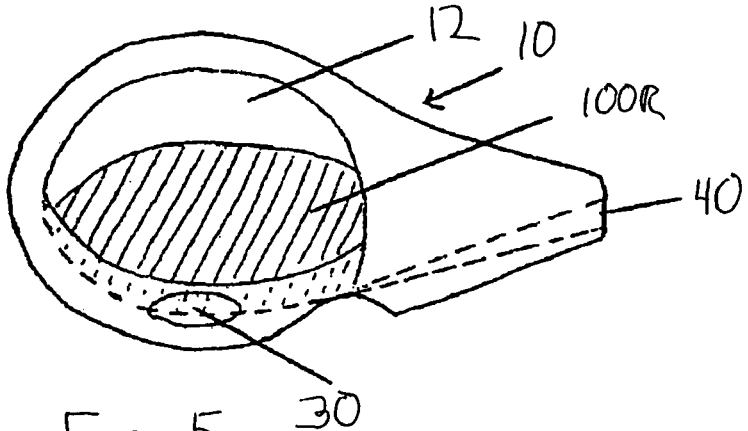
FIG. 5

OCARINA

FIELD OF THE INVENTION

This invention relates generally to a wind instrument and more particularly to a substantially enclosed wind instrument with an air chamber and fingering holes.

DESCRIPTION OF RELATED ART

An ocarina is normally defined as a relative of the woodwind musical instrument family and is usually made of clay. It is often in a generally rounded, elongated shape. Some ocarinas are called "sweet potatoes" primarily from their sweet potato-like shape. The mouthpiece is a whistle which produces sound from air passing over the mouthpiece. When one blows into the mouthpiece of an ocarina a focused stream of air is directed over a small hole called the sound hole and is split by the sharp edge of the hole. The entire whistle assembly is collectively referred to as the "voicing." The body of the ocarina has finger holes. As finger holes are opened or closed, the oscillating air changes frequency producing different pitches. The pitch of a particular note is determined by the total relationship of the volume of a vessel to the total area of the open hole or holes. This also includes the area of the sound hole. When one blows into the mouthpiece, a vacuum and opposite pressure are created, which maintains the frequency cycles creating the sound. As finger holes are opened, the oscillating air becomes less pressurized. As more and more finger holes are opened, it is believed the ocarina loses the compression needed to produce a focused tone. The result is a raspy, whispery tone quality or a complete loss of tone. The placing of the finger holes relative to the voicing, and the shape and size of the ocarina are the primary means of controlling the sound quality produced by a particular ocarina. Common wind instruments such as clarinet, flute, or recorder have an open tube and produce the frequency of the sound wave traveling up and down an air column. The ocarina is a closed vessel. The total range of the ocarina is therefore limited when compared to instruments such as a clarinet or a recorder. However, the ocarina has unique characteristics such as its particular timber and the ability to manipulate the pitch by simply altering air pressure or hole coverage.

It is well understood that motion of air, and sound produced by motion of air, is a complex phenomenon and unpredictable. The field of mathematics called "chaos theory" was developed through the study of air motion in large systems. Consequently, it is currently impossible to mathematically define and predict the sound quality produced by a particular design of an ocarina. The motion of the air within a closed vessel is so complex that it can not be predicted using mathematical models, even with super computers. This is the case not only with ocarinas but many other instruments including stringed instruments. After all, the particularly attractive sound quality of certain antique violins, such as a Stradivarius or Guarneri, cannot be reproduced through use of modern modeling and computer techniques. Consequently, designing an ocarina to produce a particular sound or to provide particular sound qualities is not a scientific process but proceeds more by trial and error, intuition, and craft, as opposed to analytical or scientific analysis.

Due to the inherent nature of the design of an ocarina, even a well designed and well built ocarina will begin to lose tone clarity as it progresses up the musical scale. Professional grade ocarinas, such as ten or twelve hole transverse ocarinas designed in Italy and Japan, can cover over 1.5 octaves. But within that 1.5 octave range, the tonal quality is compromised. Typically, tonal quality begins to decline once the first thumb hole is opened. The ocarina may play the highest tone but the timbre is typically weak, airy, and raspy and not as resonant as the lower end of the range. It is undesirable but accepted by most ocarina players and makers because it is believed to be an unavoidable characteristic of ocarina design. It is possible to produce two sound chambers within a single ocarina. This can be seen in J. S. Sumner, U.S. Pat. No. 2,194,332, in FIGS. 12, 13, and 14. There a single mouthpiece leads to two separate chambers which may have different sound characteristics. Insulated air passages can be seen in Mausolf, U.S. Pat. No. 2,145,605 and in Gretsch, U.S. Pat. No. 2,460,931. The design of multiple chambers within a single ocarina shell can be seen in Fowler et al., U.S. Pat. No. 4,893,541. This is designed as an ocarina that can only produce the notes of the pentatonic scale. In Fowler a single mouth passage leads to compartmentalized chambers, each having fingering holes. The Fowler '541 ocarina is apparently designed for children or at least neophyte musicians to use for experimentation and to build self-confidence since it will not produce discordant notes that sound "wrong"

SUMMARY OF THE INVENTION

The purpose of this invention is to produce better tonal clarity and resonance in a higher register of an ocarina. It is designed to produce a more consistent timbre throughout the entire range. It is designed to allow a more consistent air pressure to be maintained throughout the ocarina even as more holes are opened to produce a higher tone. Use of internal partitions within the interior of the ocarina helps prevent rapid loss of compression within the ocarina vessel. It does so by isolating the voicing from these open holes. Air travels from the voicing or whistle assembly and tends to "back up" to the tone holes before it escapes. Nearby tone holes have less effect because the nearby holes are somewhat isolated within the vessel by the internal partitions or partitions. Placement of the partitions or internal partition plates produces improved sound qualities. The partitions may vary internally inside the ocarina so long as they do not completely close off the vessel and partition it into more than one internal compartment within the vessel. Thus, this invention produces an ocarina that maintains better tonal quality throughout the ocarina's pitch range.

BRIEF DESCRIPTION OF THE DRAWINGS

FIGS. 3A and 3 B show the current invention ocarina cut-a-way with partitions to be placed in the cut-a-way ocarina.

FIG. 4 is a top cut-a-way view of a partitioned ocarina.

FIG. 5 is a cut-a-way view of an ocarina along lines (A-A) of FIG. 4.

DETAILED DESCRIPTION OF THE DRAWINGS

Figure 1:
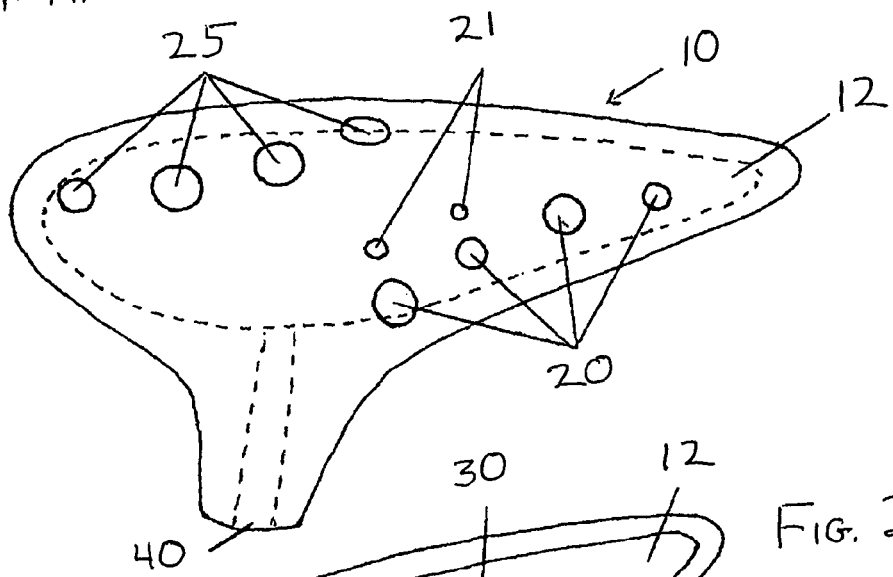
FIG. 1 Prior Art
FIG. 1 is a top view of a prior art ocarina.

FIG. 1 is a view from above of a prior art ocarina (10). As shown in FIG. 1, the left side of the top or finger hole side of the ocarina shows holes in the top surface of the ocarina (10). These are the left finger holes (25). From the viewer's perspective, positioned to the right of the left finger holes (25) are the right finger holes (20) with two sub holes (21) positioned adjacent to the index and middle finger holes of the right finger holes (20). The windway (40) is shown in dotted lines as is the cavity (12) inside the ocarina (10). The user will place the ocarina (10) to the user's mouth. The windway (40) fits the user's mouth so a user may blow in the windway (40) pushing air into the cavity (12). By alternately opening and closing the left finger holes (25) and the right finger holes (20) and the sub holes (21) a user may alter the tone and pitch of the musical sound produced by the ocarina (10).

Figure 2:
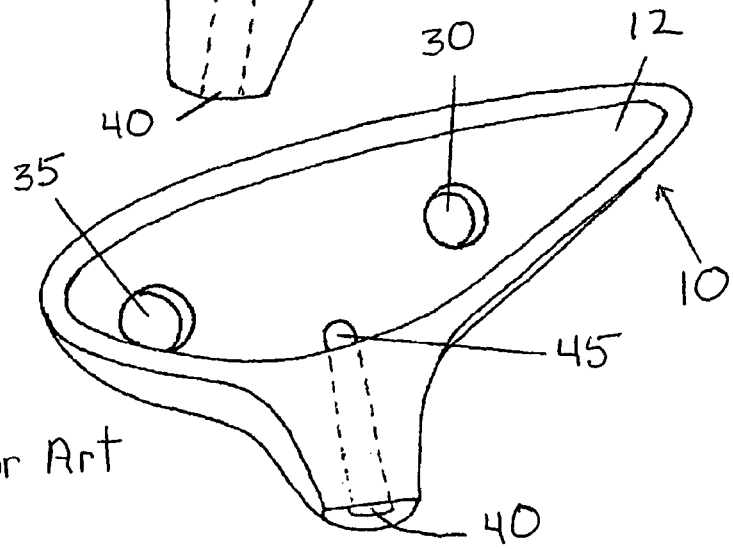
FIG. 2 is a prospective view of a cut-a-way prior art ocarina.

FIG. 2 shows a prospective view of a prior art ocarina (10) cut horizontally along an approximately bisecting line. In this view one can better see the cavity (12) of the ocarina (10). The partial groove in the lower portion of FIG. 2 is a cut-a-way portion of the windway (40). It is readily appreciated, if the ocarina was fully assembled, the windway (40) would form approximately tubular opening into the cavity (12) of the ocarina (10). In FIG. 2 one sees the sound hole (45), the left thumb hole (35), and the right thumb hole (30). The sound hole (45) is typically found on the bottom, or the thumb hole side, of the ocarina (10) and is in proximity to the windway (40) so that the wind or air blown by a user through the windway (40) will pass over the sound hole (45) creating the basic sound of the ocarina (10). Like the left finger holes (25) and the right finger holes (20), the left thumb hole (35) and the right thumb hole (30) can be alternately opened or closed to alter the pitch and tone of the sound of the ocarina (10) made by a user blowing through the windway (40) into the ocarina (10) over the sound hole (45). FIGS. 1 and 2 show a conventional ocarina (10) of standard construction. This is also the basic construction of the ocarina of this invention with the additions of partitions (100R, 100L) as shown in subsequent drawings.

FIGS. 3A and 3 B show the current invention ocarina cut along a bisecting line and folded open. FIG. 3A shows from a cut-a-way interior view the upper portion of the ocarina as seen in prior art FIG. 1. The left finger holes (25) and the right finger holes (20) are seen from the inside, as are the two sub holes (21). The windway (40) begins at the midpoint of the ocarina but quickly angles downwardly toward the sound hole (45). Consequently, the main portion of the windway (40) is shown in dotted lines in FIG. 3B. In this invention, the addition of partitions (100R, 100L), as seen in FIG. 3B, is used to produce a superior sound for an ocarina (10). The preferred embodiment contains two partitions (100L, 100R). Partition (100L) is placed in proximity to the left thumb hole (35) and partition (100R) is placed in proximity to the right thumb hole (30). The exact placement and size of the partitions may be subject to some variation. In this embodiment, the left partition (100L) and the right partition (100R) both are placed between the windway (40) and the sound hole (45) and respectively left thumb hole (35) and right thumb hole (30) as is shown in FIG. 3. In the preferred embodiment, both the left partition (100L) and right partition (100R) are sized so that a portion that extends above a mid-line of the ocarina (10). At least one partition should be placed between the voicing (the windway (40) and sound hole (45)) and a finger or thumb hole placed on the same side of the ocarina (10) as the sound hole (45). It is believed a partition so placed affects air pressure in the ocarina (10), thus providing better tonal quality in the higher registers.

FIG. 4 is a view of a cut-a-way ocarina (10) that shows placement of the left partition (100L) and right partition (100R) between the thumb holes (35) and (30) and the sound hole (45). Partitions (100L) and (100R) are attached to the inner wall of the ocarina and placed between the sound hole (45) and the largest of the finger and thumb holes. These partitions (100L, 100R) may prevent the rapid loss of compression within the ocarina (10) vessel by separating the windway (40) and sound hole (45) from the largest finger holes or thumb holes. Air travels down the windway (40) and fills the cavity (12) of the ocarina (10). Because the air has enough time to form the vacuum/pressure cycle, tone clarity and resonance is dramatically improved. This invention is best suited to the traditional sweet potato style ocarina in which the vessel is oval, like an elongated egg, and the windway (40) is positioned perpendicular to the lengthwise dimension of the ocarina (10) and placed somewhat left of the midpoint of the lengthwise dimension of the ocarina (10). The ocarina (10) is held similar to a flute with the finger holes for the left and right hands on top and thumb holes on the bottom positioned on either side of the sound hole (45). However, the invention is not limited to a particular style or shape of an ocarina. Regardless of the form of the ocarina (10), if the ocarina (10) has finger and thumb holes on the same side of the ocarina as the voicing, partitions (100) could be used to isolate the voicing or windway (40) and sound hole (45) from the thumb holes and/or finger holes positioned on that side of the ocarina (10).

FIG. 5 is a cut-a-way view of the ocarina (10) along line (A-A) in the direction of the arrows from the right thumb hole (30) end of the ocarina (10). The windway (40) is seen in dotted lines. The right partition (100R) is seen in crosshatch lines. Because the ocarina (10) forms an approximately rounded cone like shape as it goes toward the right end, the actual thumb hole (30) is seen in dotted lines because it would be behind the edge of the cavity (12) as cut-a-way on line (A-A). FIG. 5 demonstrates that in the preferred embodiment the partition (100R) extends slightly above mid-line of the ocarina (10). The relationship between the height of the partition (100R) and the dimensions of the cavity (12) can, to some degree, be a matter of variation but partition (100R) cannot entirely seal off one part of the cavity (12) from the other parts of the cavity (12). There must be room for passage of air within the cavity around and above the partition (100R).

Figure 6:
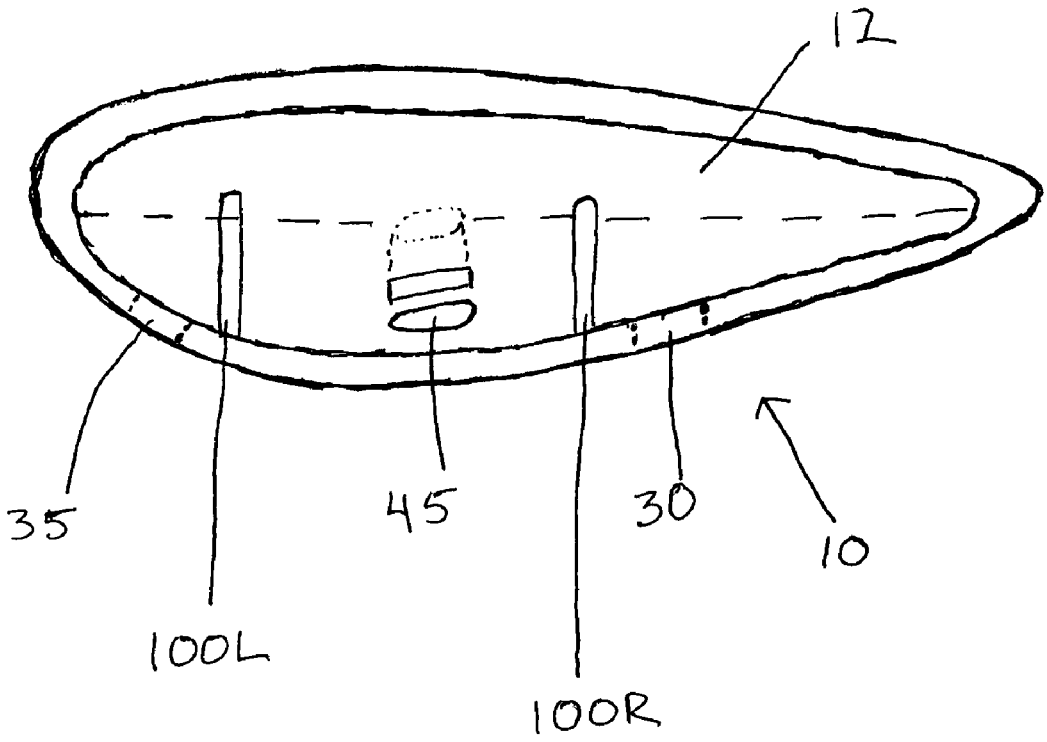
FIG. 6 is a cut-a-way view of an ocarina along lines (B-B) of FIG. 4.

FIG. 6 is a lengthwise cut-a-way view along (B-B) in the direction of the arrows of FIG. 4 of the ocarina (10). The viewer is opposite from the windway (40). The windway (40) begins approximately on a bisecting line (shown in dotted lines) in FIG. 6. The left partition (100L) and the right partition (100R) extends slightly above bisecting line on the mid-line of the cavity (12). The left thumb hole (35) is shown positioned to the left of the partition (100L) and the right thumb hole (30) is shown to the right of the right partition (100R). It will be seen that as air enters the windway (40) it goes the downwardly angled passage shown in FIG. 5 and enters the cavity (12) at a point on the thumb holes (30,35) side of the cavity (12) and in proximity to the sound hole (45). Then it must first pass over the partitions (100L) and (100R) to reach the left thumb hole (35) and the right thumb hole (30). These partitions (100L) and (100R) form a partial barrier to the movement of air in the cavity (12) as air enters through the windway (40). The partitions (100L) and (100R) also form a partial barrier to air entirely escaping from the ocarina (10), meaning that air pressure is maintained in the ocarina (10) better with the partitions (100L) and (100R) in place than if they are not placed within the cavity (12) of the ocarina (10). It is believed that the effect of the partitions (100L) and (100R) is to help maintain sufficient air pressure within the cavity (12) to help maintain tonal quality which can be lost if air pressure drops below a certain level. While variation and placement and size of the partitions (100L) and (100R) is permitted, it is believed that for the partitions to work best they must be placed between the windway (40) and sound hole (45) and the larger thumb or finger holes, here, shown as thumb holes (30) and (35). Moreover, it is believed that the partition should extend above the midline of the ocarina as is shown in FIG. 6. It is also believed that the partition (100L) should be in near proximity to the left thumb hole (35) and the right partition (100R) should be in near proximity to the right thumb hole (30).

Figure 7:
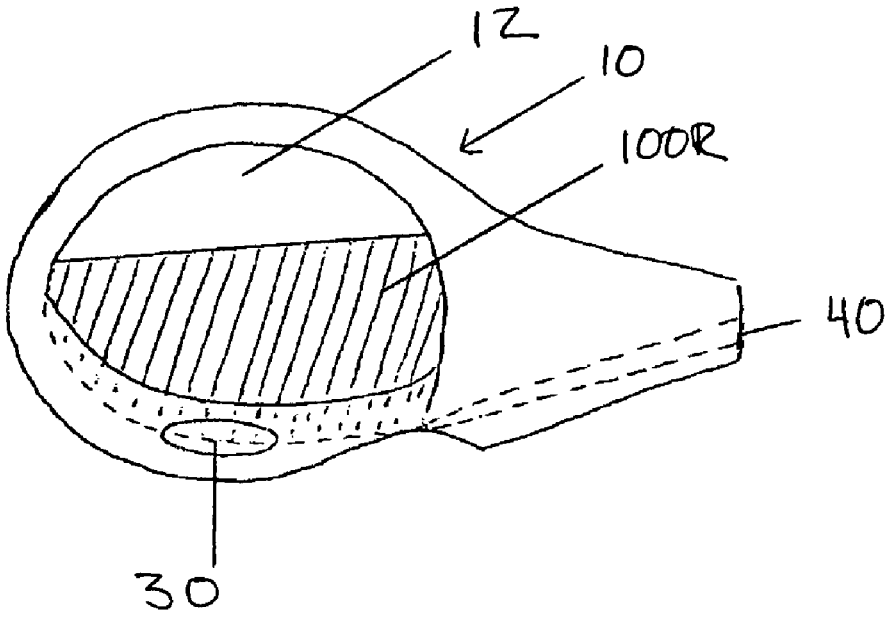
FIGS. 7 and 8 show alternative constructions for the partitions.
Figure 8:
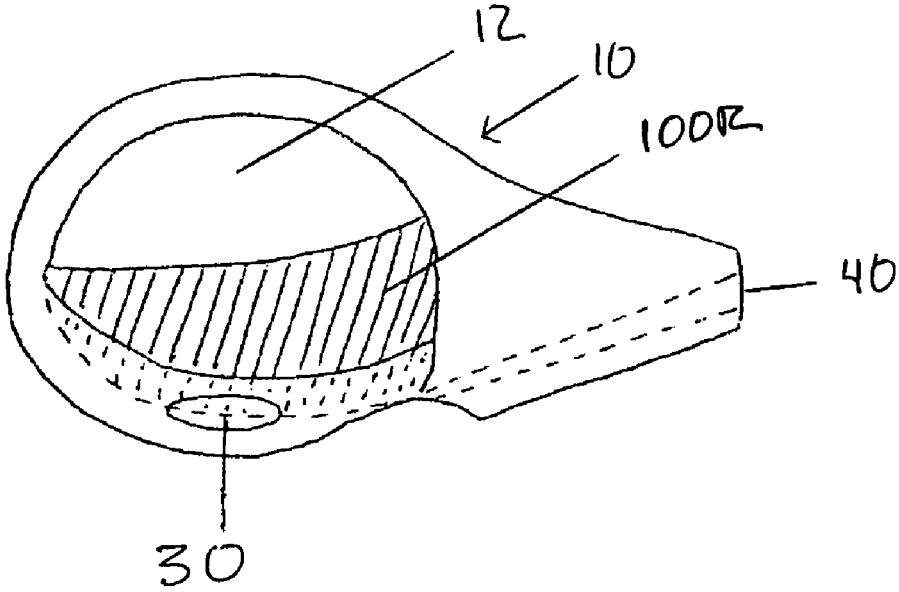

FIGS. 7 and 8 show alternative constructions of the partition (100R) along line (A-A) in FIG. 4. The actual shape of the partition (100R) is less important than its dimensions and location within the ocarina (10). As shown in FIG. 6, it is important that the partitions (100R) and (100L) be located between the voicing (the windway (40) and sound hole (45)) and the largest finger/thumb holes (35 and 30). They (35 and 30) are on the same side or bottom side of the ocarina (10). It is believed that the partitions (100R) and (100L) are more effective if they extend above the line bisecting the ocarina shown as a dotted line on FIG. 6 but terminate before completely separating the ocarina (10) into separate sections. The upper shape of the partitions (100R) and (100L) can be a concave or convex arcuate shape shown in FIGS. 8 and 5 or could be a straight line as shown in FIG. 7. In FIG. 7 the upper dimension of the partitions (100R and 100L) generally rises from the side of the ocarina (10) that is opposite to windway (40). It is believed that other variations in the shape of the partitions (100R and 100L) are possible while remaining within the general scope of this invention. The critical aspect of the shape and size of the partition (100R) or partition (100L) is that they be large enough to affect flow of air within the interior (12) of the ocarina (10) to help maintain appropriate air pressure even as the larger thumb holes/finger holes (35, 30) are opened and closed. While it is believed the partitions function by affecting the air pressure within the interior cavity (12) of the ocarina (10), it is also possible that other factors may be in play. The partitions may have the effect of stiffening the structure of the overall ocarina (10) thereby affecting the resonance, hence tone. However, because placement for the partitions (100L) and (100R) function better when they are closer to the thumb holes (30) and (35) buttresses the conclusion that the primary reason the partitions (100L) and (100R) improve the tone of the ocarina (10) alter the effect of the partitions (100L) and (100R) on the interior flow of air within the ocarina (10) and the air pressure that results from that flow. None of the foregoing discussion is intended by way of limitation but is an illustration of the invention. The only limitations appear in the claims which follow.

I claim:

1. An improved ocarina for maintenance of tonal quality comprising:

(a) an ocarina with upper and lower surface defining a single cavity and single windway forming an opening into said cavity of said ocarina with a sound hole in said ocarina in proximity to cavity side of said windway;

(b) a plurality of finger holes on said ocarina;

(c) at least one first partial partition in said cavity of said ocarina, said at least one partial partition in proximity to at least one of said plurality of finger holes and between at least one said finger holes and said sound hole and said at least one first partial partition extends into said cavity of said ocarina from a side of said cavity where said sound hole is located;

(d) for said plurality of finger holes a first finger hole is located on said sound hole side of said cavity with said at least one first partial partition in proximity to said first finger hole and between said first finger hole and said sound hole.

2. An improved ocarina for maintenance of tonal quality of claim 1 wherein at least one first partial partition has an area at least 50 percent of a cross section of said cavity where said first partition is located.

3. An improved ocarina for maintenance of tonal quality of claim 2 wherein said plurality of finger holes there is a second finger hole on said sound hole side of said cavity and distal from said first finger hole, with a second partial partition located in proximity to said second finger hole and between said second finger hole and said sound hole.

4. An improved ocarina for maintenance of tonal quality of claim 3 wherein said second partial partition has an area of at least 50 percent of a cross section of said cavity where said second partition is located.

5. An improved ocarina for maintenance of tonal quality of claim 4 wherein said first partial partition is located closer to said first finger hole than said sound hole and said second partial partition is located closer to said second finger hole than said sound hole.

6. An improved ocarina for maintenance of tonal quality of claim 5 wherein said first finger hole and said second finger hole are at least as large in area as any remaining finger holes in said plurality of finger holes.

7. A sweet potato shaped ocarina having a single cavity therein with a plurality of finger holes on a first top side of said ocarina and at least two thumb holes on a second bottom side of said ocarina comprising:

(a) a single windway forming an opening into said cavity of said ocarina with a sound hole on said second bottom side of said ocarina in proximity to the opening formed in said cavity in said ocarina by said windway;

(b) between said sound hole and a first thumb hole, a first partial partition;

(c) between said sound hole and a second thumb hole, a second partial partition.

8. A sweet potato shaped ocarina having a single cavity therein with a plurality of finger holes on a first top side of said ocarina and at least two thumb holes on a second bottom side of said ocarina of claim 7 wherein said first partial partition is closer to said first thumb hole than to said sound hole and said second partial partition is closer to said second thumb hole than said sound hole.

9. A sweet potato shaped ocarina having a single cavity therein with a plurality of finger holes on a first top side of said ocarina and at least two thumb holes on a second bottom side of said ocarina of claim 8 wherein said first partial partition has an area of at least 50 percent of a cross section of said cavity where said first partial partition is located.

10. A sweet potato shaped ocarina having a single cavity therein with a plurality of finger holes on a first top side of said ocarina and at least two thumb holes on a second bottom side of said ocarina of claim 9 wherein said second partial partition has an area of at least 50 percent of a cross section of said cavity where said second partial partition is located.

11. A sweet potato shaped ocarina having a single cavity therein with a plurality of finger holes on a first top side of said ocarina and at least two thumb holes on a second bottom side of said ocarina of claim 10 wherein said first thumb hole is larger than any finger hole and said second thumb hole is larger than any finger hole.

* * * * *